US008157593B1

(12) United States Patent
Sim et al.

(10) Patent No.: US 8,157,593 B1
(45) Date of Patent: Apr. 17, 2012

(54) METHOD OF SHIELDING A CONNECTOR MODULE FROM ELECTROMAGNETIC INTERFERENCE WITH ELONGATE MEMBERS OF CONDUCTIVE MATERIAL AND RELATED APPARATUS

(75) Inventors: Soon Peng Jason Sim, Singapore (SG); Cheng Nam Lee, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 12/969,611

(22) Filed: Dec. 16, 2010

(51) Int. Cl.
*H01R 13/68* (2011.01)

(52) U.S. Cl. ..... 439/607.28; 439/939; 439/927

(58) Field of Classification Search ..... 439/540.1, 439/607.01, 607.28, 607.2, 607.19, 636, 439/79, 927, 108; 174/355, 356
See application file for complete search history.

(56) References Cited

U.S. PATENT DOCUMENTS

| | | | | |
|---|---|---|---|---|
| 6,280,257 | B1 * | 8/2001 | North et al. | 439/680 |
| 6,508,653 | B2 | 1/2003 | Malone et al. | |
| 6,534,706 | B1 | 3/2003 | Rapp | |
| 6,660,933 | B2 | 12/2003 | Festag | |
| 6,840,817 | B2 | 1/2005 | Chen | |
| 7,438,596 | B2 * | 10/2008 | Phillips | 439/607.01 |
| 7,704,098 | B2 | 4/2010 | Lambie et al. | |
| 2009/0264002 | A1 * | 10/2009 | Bright et al. | 439/271 |

* cited by examiner

*Primary Examiner* — Edwin A. Leon

(57) ABSTRACT

An electronic communications equipment chassis has a panel with an aperture for receiving a connector module having at least one female jack. A plurality of elongate members of conductive material are attached to the panel, project into the aperture and form an EMI shield around the connector module.

16 Claims, 4 Drawing Sheets

Fig. 2
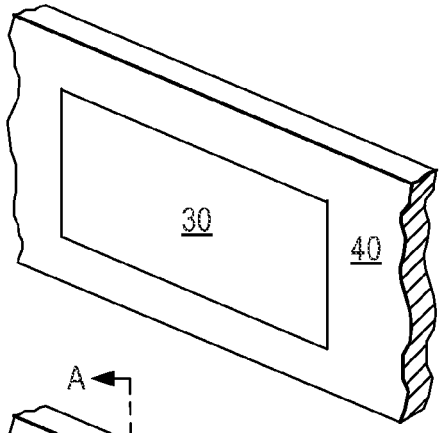
Fig. 3
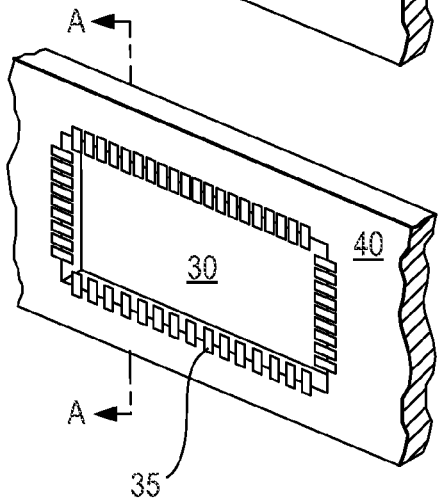
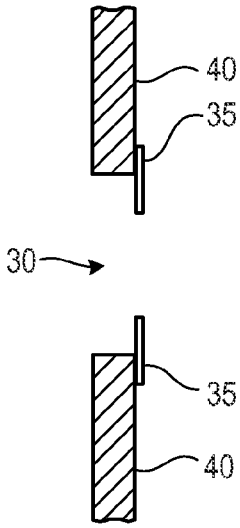
Fig. 4
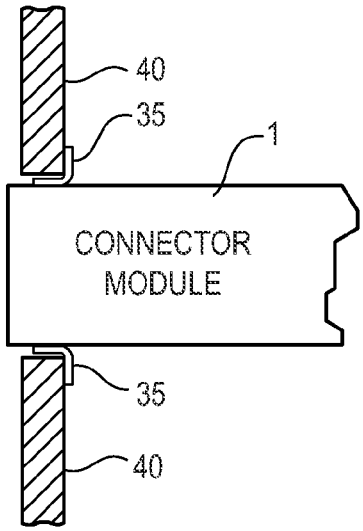
Fig. 5

METHOD OF SHIELDING A CONNECTOR MODULE FROM ELECTROMAGNETIC INTERFERENCE WITH ELONGATE MEMBERS OF CONDUCTIVE MATERIAL AND RELATED APPARATUS

BACKGROUND OF THE INVENTION

Communications equipment, such as networking equipment, telecommunications equipment, routers and switches, commonly use connection jacks to connect the equipment to cables which carry high speed data signals.

A connection module having a plurality of female jacks for receiving connector plugs is often used. The connection module fits into an aperture in a front panel of the communications equipment chassis. Electromagnetic interference (EMI) shielding may be provided by metal fingers (known as EMI fingers) located on the external walls of the connection module. The EMI fingers are stamped from the sheet metal of the connection module and form an integral part of the connection module.

BRIEF DESCRIPTION OF THE DRAWINGS

Some examples are described in the following figures:

FIG. 2 shows an example of part of a panel of a communications equipment chassis having an aperture for receiving the connector module of FIG. 1;

FIG. 3 shows an example of part of a panel of a communications equipment chassis having an aperture for receiving a connector module and a plurality of elongate members of conductive material extending into the aperture;

FIG. 4 is a cross section along the line A-A of FIG. 3;

FIG. 5 is a cross section along the line B-B of FIG. 6 and shows a connector module inserted into the aperture;

DETAILED DESCRIPTION

Figure 1:
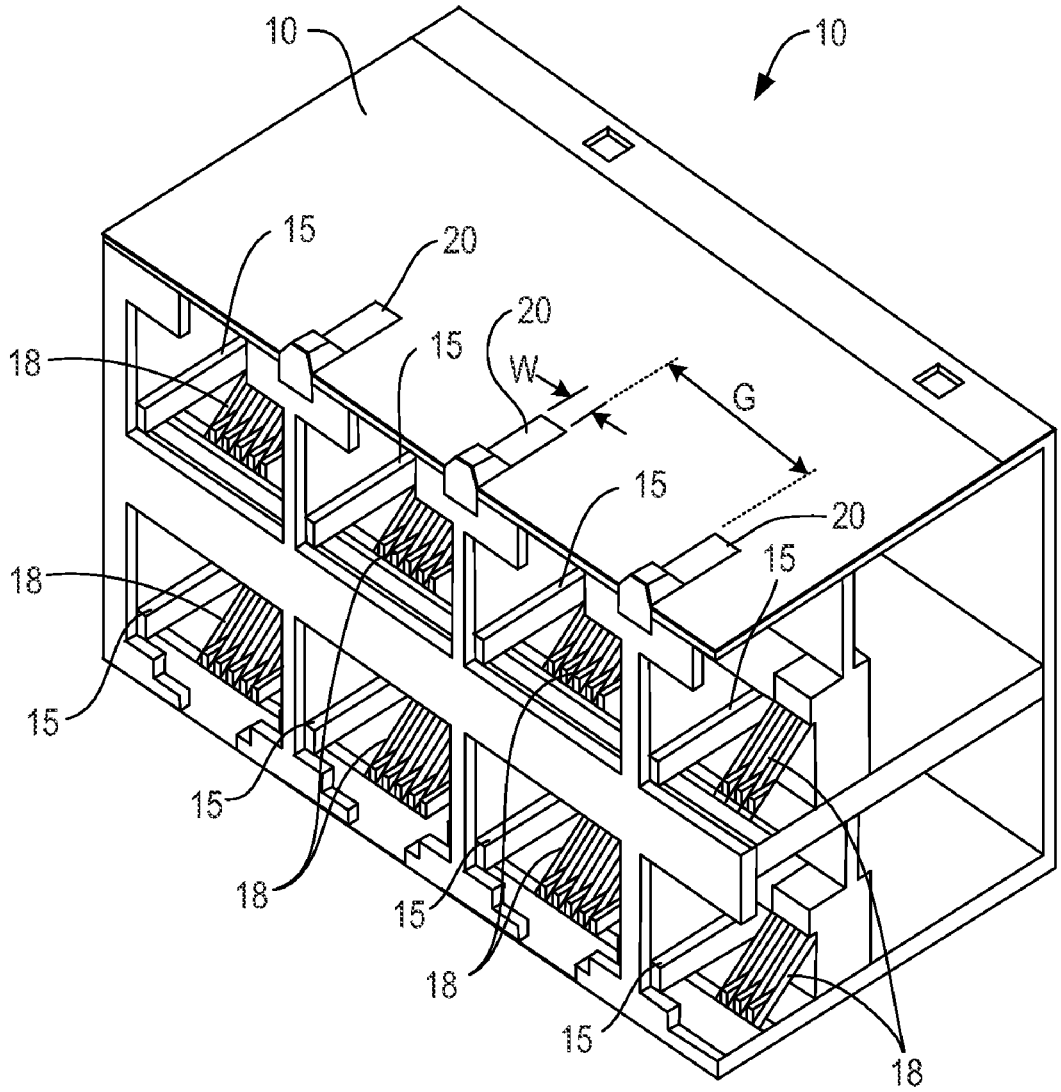
FIG. 1 shows an example of a connector module comprising a plurality of female jacks.

FIG. 1 shows a connector module 1 comprising external walls 10 and a plurality of female jacks 15. Each female jack 15 comprises a compartment for receiving a male connector plug, such as a RJ 45 plug for example. The jack may have several metal connectors 18 inside the compartment for contacting and connecting with the plug.

FIG. 2 shows an example of a front panel 40 of a communications equipment chassis having an aperture 30 for receiving a connector module, such as that shown in FIG. 1. The front panel 40 may be a ground plane or electrically connected to a ground plane of the chassis. Examples of communications equipment include networking equipment, telecommunications equipment, switches, routers etc.

Electromagnetic interference (EMI) shielding is provided by fingers 20 of sheet metal on the external wall of the connector module 1. The fingers 20 are known as EMI fingers. In an example the fingers 20 are stamped from the sheet metal which forms the external wall of the connector module and the fingers form an integral part of the external wall. The EMI fingers 20 are relatively wide and there are relatively large gaps between them. In one example the EMI fingers have a width W of 2 mm and are spaced apart by gaps G of 10 mm. When the connector module 1 is inserted into the aperture 30, the EMI fingers 20 contact the walls of the aperture and form an electrical connection with the front panel 40. Unwanted EMI interference is thus conducted by the EMI fingers to the panel 40 and to ground. In this way the connectors are shielded from noisy digital signal currents in a PCB of the communications equipment. Likewise the PCB and other internal parts of the communications equipment are shielded from EMI arising from the data cables.

In modern communications equipment the data transfer rate may for example be 1 GB/s, 10 GB/s or even higher. As speeds increase, it is advantageous to improve the EMI shielding. One method of doing this would be to increase the number of EMI fingers and place them closer together. However, this requires expensive re-tooling and time consuming negotiations with the manufacturers of the connection modules. Furthermore, increasing the number of EMI fingers also risks comprising the mechanical integrity of the connector module as the fingers are stamped from the external walls of the module.

Figure 6:
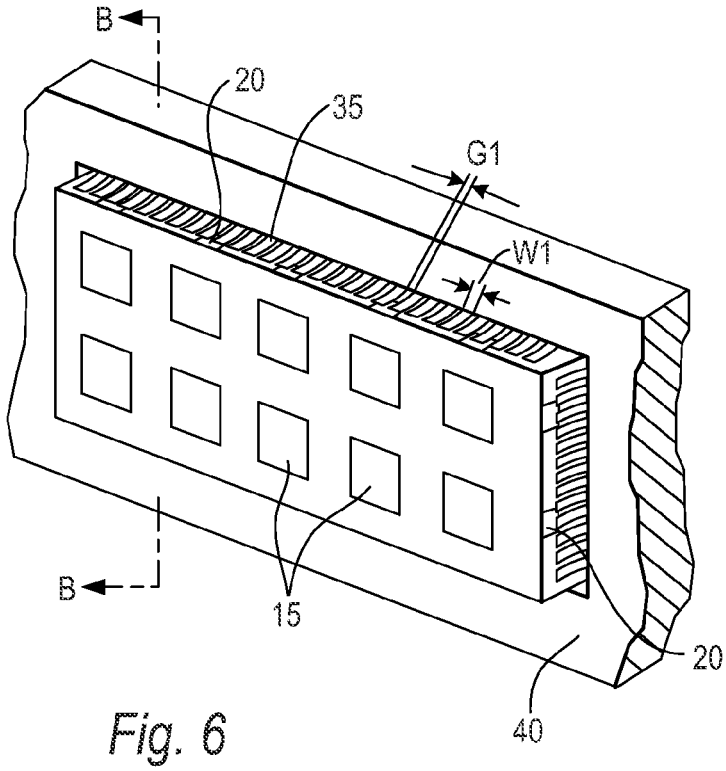
FIG. 6 shows an example of a connector module inserted into the aperture of a panel of a communications equipment chassis and a plurality of elongate members of conductive material forming an EMI shield around the connector module.

FIG. 3 shows an example of a front panel 40 of a communications equipment chassis having an aperture 30 for receiving a connector module. A plurality of thin, elongate conductive members 35 are attached to the front panel 40 and project into the aperture 30 in a direction parallel with the plane of the front panel 40. A cross sectional view along the line A-A of FIG. 3 is shown in FIG. 4. In this example the conductive members are provided on all sides of the aperture to provide EMI shielding on all sides. The elongate members of conductive material 35 are sufficiently soft and flexible that they bend to accommodate the connector module 1 when it is inserted into the aperture 40. FIGS. 5 and 6 illustrate the situation when a connector module 1, such as that shown in FIG. 1, is inserted into the aperture 30 of a panel 40 such as that shown in FIGS. 3 and 4. The elongate members have first ends attached to the panel 40 and second ends which rest on and make contact with the outer wall of the connector module 1.

In the example shown in FIGS. 5 and 6 the elongate members 35 bend backwards by approximately 90 degrees in the direction of insertion of the connector module. They thus contact along the outer wall of the connector module and form an electrically conductive connection therewith. The elongate members are thin and closely spaced together and thus form an effective EMI shield. It can be seen in FIG. 6 that some elongate members 35 extend in the gaps between the EMI fingers 20 of the connector module. Other elongate members 35 may also extend over and make conductive contact with the EMI fingers 20.

In the example shown in FIGS. 3-6 the elongate members of conductive material are thin strips of conductive material. In one example the elongate members have a width W1 of 1.5 mm or less as shown in FIG. 6. In another example the elongate members have a width W1 of 1 mm or less, or 0.5 mm or less. The elongate members may be placed close together so there is either no gap or very small gaps between them. In one example the elongate members are spaced apart by a gap G1 of 0.1 mm or less. However, while in the example of FIG. 6 the elongate members are substantially equally spaced apart, this does not necessarily have to be the case. It would be possible for the spacing to vary. It would also be possible for some pairs of elongate members to have significantly larger gaps between them; this could for example enable the arrangement to accommodate obstructions in or protrusions of the connector module or chassis. In one example the conductive members are welded to the panel. In another example the conductive members are secured to the chassis panel 40 by an adhesive (the adhesive used should be conductive so that the conductive members are in conductive contact with the panel). In one example the elongate members are made of thin electrically conductive metal. In one example the elongate members are made of thin strips of steel. In one example, the thickness of the elongate members—measured in the direction left to right of FIG. 4—is 0.1 mm or less.

Figure 9:
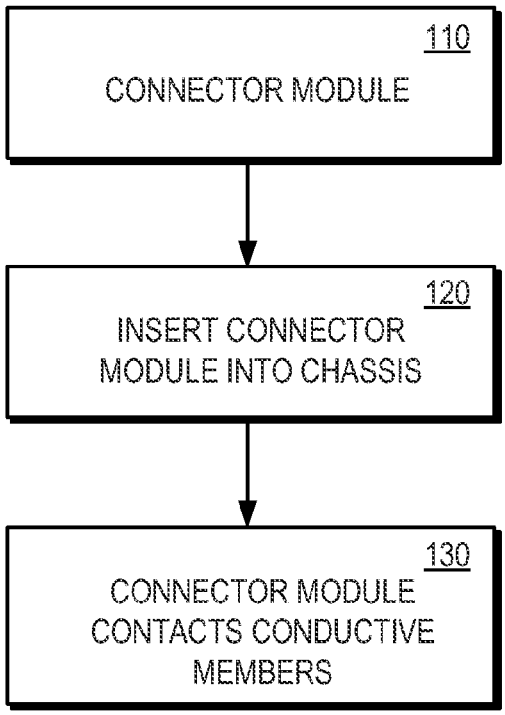
FIG. 9 is a flow diagram for a method of shielding a connector module in communications equipment from electromagnetic interference.
Figure 7:
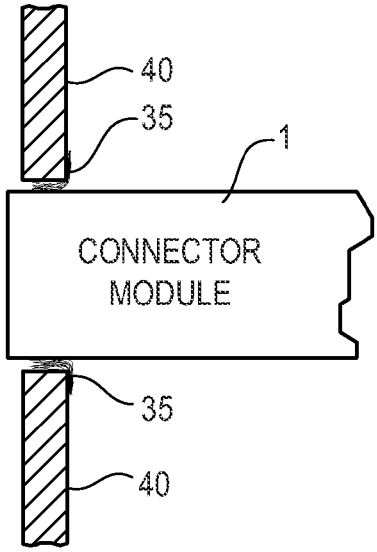
FIG. 7 is a cross section along the line C-C of FIG. 8.
Figure 8:
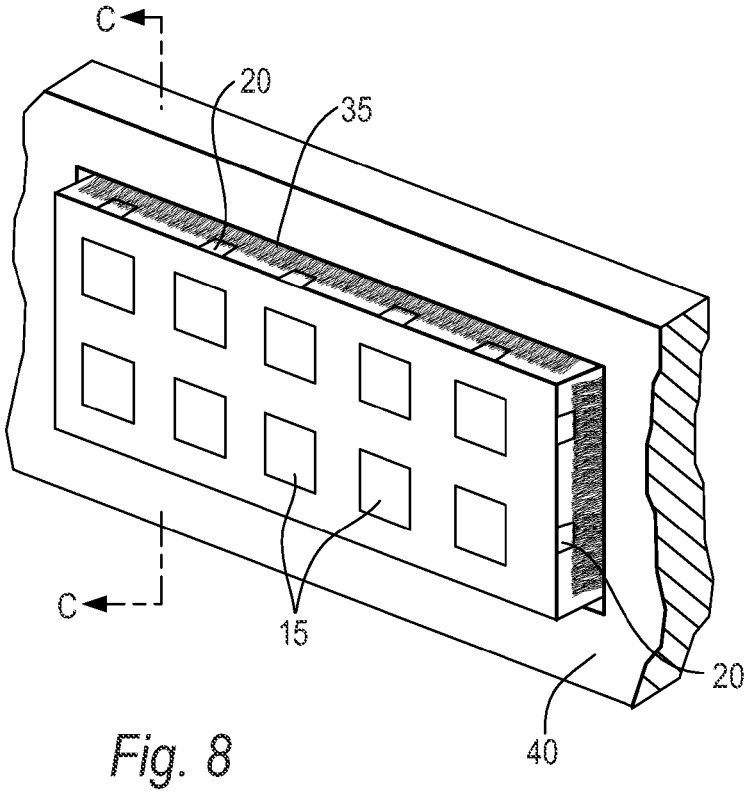
FIG. 8 shows an example of a connector module inserted into the aperture of a panel of a communications equipment chassis and a plurality of conductive brush bristles forming an EMI shield around the connector module.

FIG. 8 shows another example, which is similar to FIG. 6, but in which the elongate members of conductive material 35 are conductive brush bristles. For example they may be a plurality of densely packed, soft and flexible metal wires. This arrangement works well due to the high density and high pitch of the bristle wires. FIG. 7 shows the cross section along the line C-C of FIG. 8. The bristles may be one layer thick, but in the example of FIG. 7 they are several layers thick. E.g. there may be several overlapping bristles wires one behind the other in the direction left to right of FIG. 7 and the overlapping bristles wires may be fixed together at the top (e.g. by adhesive or welding). This can help to provide an even higher density of conductive contacts between the connector module and the panel to provide even better EMI shielding in the presence of high frequency EM signals. In one example the conductive brush bristles are 0.3 mm or less in diameter; in another example the conductive bristles have an average diameter of 0.254 mm. In one example the conductive brush bristles are spaced apart by an average of 0.1 mm or less. FIG. 8 shows a substantially continuous line of brush bristles at each edge of the aperture. However, instead of a continuous line it would alternatively be possible to have plural bunches of bristles, and at least some of the bunches being separated from next bunch by a gap. For example, this could enable the arrangement to cope with obstructions on the connector module or chassis or to reduce the number of brush bristles used. FIG. 9 is a flow chart of a method of providing EMI shielding in one example. At 110 a connector module having one or more female jacks is provided. At 120 the connector module is inserted into the aperture of a panel of a communications equipment chassis. At 130 the connector module contacts elongate conductive members, such as conductive brush bristles, which are secured to the panel and extend into the aperture. The elongate conductive members flex to accommodate the connector module and bend backwards in the direction of insertion of the module. The elongate members form an EMI shield around the module and conduct unwanted EMI interference to the panel and to ground.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. An electronic communications equipment chassis comprising:

a panel having an aperture extending along a plane of the panel, said aperture for receiving a connector module having at least one female jack;

a plurality of elongate members of conductive material attached to the panel around the periphery of the aperture and projecting into the aperture in a direction substantially parallel with the plane of the panel, the plurality of elongate members of conductive material being flexible and sufficiently soft such that if a connector module is inserted into the aperture, the plurality of elongate members of conductive material bend backwards to accommodate the connector module and form a EMI shield around the connector module.

2. The chassis of claim 1 wherein the chassis is a chassis for networking or telecommunications equipment.

3. The chassis of claim 1 wherein the elongate members of conductive material are conductive brush bristles.

4. The chassis of claim 1 wherein the elongate members are thin strips of conductive material having a width of no more than 1.5 mm.

5. The chassis of claim 1 wherein the elongate members of conductive material are spaced apart by an average of 0.1 mm or less.

6. The chassis of claim 1 wherein the elongate members are made from steel.

7. The chassis of claim 1 wherein the panel is a ground plate or is electrically connected to a ground plate.

8. The chassis of claim 1 in combination with a connector module having at least one female jack for receiving a plug; the connector module being located in the aperture and the elongate members of conductive material bending to accommodate the connector module and forming a EMI shield around the connector module.

9. The combination of claim 8 wherein the elongate members bend by approximately 90 degrees to accommodate the connector module.

10. The combination of claim 8 wherein the connector module has an external wall and a plurality of EMI fingers on the external wall; wherein the elongate members are spaced more closely together than the EMI fingers and wherein the elongate members contact parts of the external wall which are not shielded by the EMI fingers.

11. The combination of claim 8 wherein the connector module has a plurality of RJ jacks each for receiving a connector plug.

12. The combination of claim 8, wherein the connector module has a plurality of female jacks, and wherein each of the plurality of female jacks is to receive a plug.

13. A method of shielding a connector module from electromagnetic interference in communications equipment, the connector module having at least one female jack for receiving a plug and an external wall surrounding the at least one female jack; the communications equipment having a chassis comprising a panel with an aperture extending along a plane of the panel, said aperture for receiving the connector module; the method comprising:

contacting the external wall of the connector module with a plurality of elongate members of conductive material attached to the panel and extending into the aperture in a direction substantially parallel with the plane of the panel, so as to form an electrical connection between the external wall of the connector module and the chassis of the communications equipment.

14. The method of claim 13 wherein the connector module is inserted into the aperture and the elongate members of conductive material flexibly bend backwards in the direction of insertion when the connector is module is inserted into the aperture.

15. The method of claim 13 wherein the elongate members are conductive brush bristles.

16. The method of claim 13, further comprising:

attaching the plurality of elongate members of conductive material onto the panel prior to contacting the external wall of the connector module with the plurality of elongate members.

* * * * *

UNITED STATES PATENT AND TRADEMARK OFFICE

CERTIFICATE OF CORRECTION

PATENT NO. : 8,157,593 B1
APPLICATION NO. : 12/969611
DATED : April 17, 2012
INVENTOR(S) : Soon Peng Jason Sim et al.

It is certified that error appears in the above-identified patent and that said Letters Patent is hereby corrected as shown below:

IN THE CLAIMS:

In column 5, line 4, in Claim 14, after "connector" delete "is".

Signed and Sealed this
Fourth Day of December, 2012

David J. Kappos

David J. Kappos
*Director of the United States Patent and Trademark Office*